US006246342B1

(12) United States Patent
Vandevoorde et al.

(10) Patent No.: US 6,246,342 B1
(45) **Date of Patent: *Jun. 12, 2001**

(54) MAN-MACHINE INTERFACE FOR AIRPORT TRAFFIC CONTROL PURPOSES

(75) Inventors: Jean-Claude Vandevoorde, Steenkokkerzeel (BE); Robert Castor, Unterschleissheim (DE); Andre Jelu, Tienen (BE)

(73) Assignee: Siemens Aktiengesellschaft, Munich (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/261,261

(22) Filed: Mar. 3, 1999

Related U.S. Application Data

(63) Continuation of application No. PCT/DE97/01896, filed on Aug. 29, 1997.

(30) Foreign Application Priority Data

Sep. 3, 1996 (DE) ..... 196 35 679

(51) Int. Cl.[7] ..... G08G 5/04

(52) U.S. Cl. ..... 340/961; 340/947; 340/933; 340/953; 342/29; 342/36; 342/59; 342/450; 342/456; 701/16; 701/120

(58) Field of Search ..... 340/947, 961, 340/933, 953, 29; 342/36, 59, 456, 450; 701/120, 16, 301; 455/456

(56) References Cited

U.S. PATENT DOCUMENTS 4,365,315 12/1982 Jamnik ..... 704/8
4,688,046 * 8/1987 Schwab ..... 342/456
4,706,198 * 11/1987 Thurman ..... 701/120

(List continued on next page.)

FOREIGN PATENT DOCUMENTS

| | | |
|---|---|---|
| 42 16 281 A1 | 11/1993 | (DE) . |
| 43 04 562 A1 | 8/1994 | (DE) . |
| 195 04 923 A1 | 8/1996 | (DE) . |
| 0 714 082 A2 | 5/1996 | (EP) . |
| 0 725 283 A1 | 8/1996 | (EP) . |
| 2 634 945 | 2/1990 | (FR) . |
| 2 668 012 | 4/1992 | (FR) . |
| 2 289 556 | 11/1995 | (GB) . |
| 97/32291 | 9/1997 | (WO) . |

OTHER PUBLICATIONS

Remington's Pharmaceuticals Sciences, 18th Edition, 1990, pp. 207 and 208, Gennaro et al.

Kiesewalter et al., "Computerized Taxiway Control Systems Improve Airport Capacity Utilization," *Engineering and Automation*, Bd. 13, No. 5, Sep. 1, 1991, pp. 8–13.

F. G. Monzel et al., "Surface Movement Guidance and Control System," *Electrical Communication*, 1st Quarter, Jan. 1, 1993, pp. 51–59.

*Primary Examiner*—Benjamin C. Lee
(74) *Attorney, Agent, or Firm*—Sughrue, Mion, Zinn, Macpeak & Seas, PLLC

(57) ABSTRACT

Man-machine interface (MMI) for airport traffic control purposes, in particular for safe taxiing and/or approach-departure control at an airport, having a display area on which processes and states at the airport, for example the movements and the current position of aircraft, the switching state of lighting systems, etc., can be displayed and influenced. The display area is designed with a screen whose diagonal is more than 19 inches, preferably more than 21 inches.

61 Claims, 14 Drawing Sheets

U.S. PATENT DOCUMENTS

| | | | | |
|---|---|---|---|---|
| 5,211,463 | | 5/1993 | Kalmanash | 342/36 |
| 5,262,784 | | 11/1993 | Drobnicki et al. | 342/45 |
| 5,268,698 | * | 12/1993 | Smith, Sr. et al. | 342/450 |
| 5,351,194 | * | 9/1994 | Ross et al. | 455/456 |
| 5,374,932 | | 12/1994 | Wyschogrod et al. | 362/26 |
| 5,375,058 | * | 12/1994 | Bass | 701/120 |
| 5,385,738 | | 1/1995 | Yamahira et al. | 424/489 |
| 5,448,243 | * | 9/1995 | Bethke et al. | 342/59 |
| 5,485,151 | | 1/1996 | Runyon et al. | 340/953 |
| 5,557,278 | * | 9/1996 | Piccirillo et al. | 342/29 |
| 5,629,691 | * | 5/1997 | Jain | 340/961 |
| 5,638,057 | * | 6/1997 | Williams | 340/947 |
| 5,659,475 | * | 8/1997 | Brown | 701/120 |
| 5,712,785 | * | 1/1998 | Mok et al. | 701/16 |
| 5,719,567 | * | 2/1998 | Norris | 340/953 |
| 5,867,804 | * | 2/1999 | Pilley et al. | 701/120 |

* cited by examiner

MAN-MACHINE INTERFACE FOR AIRPORT TRAFFIC CONTROL PURPOSES

This is a Continuation of International application PCT/DE97/01896, with an international filing date of Aug. 29, 1997, the disclosure of which is incorporated into this application by reference. International Application PCT/DE97/01896, in turn, claims priority from German Application No. 19635679.2, filed Sep. 3, 1996, the disclosure of which is also incorporated in this application by reference.

FIELD OF AND BACKGROUND OF THE INVENTION

The invention relates to new and useful improvements to a man-machine interface (MMI) for airport traffic control purposes. More particularly, the invention relates to a man-machine interface (MMI) for safe taxiing and/or approach-departure control at an airport, having a display area on which processes and situations at the airport can be displayed and, possibly, can be influenced, for example the movements and the current positions of aircraft, and, possibly, vehicles, and lighting system switching states, etc.

The man-machine interfaces (MMI) in airport control centers, for example in air traffic control towers, have until now comprised relatively small screens, arranged in groups alongside one another. The screens are connected to computer units in which the information relating to an airport is collected, processed and changed to a form which can be displayed. Examples, in particular relating to processing, can be found in U.S. Pat. Nos. 5,374,932, 5,485,151 and 5,262,784, which are incorporated into the present application by reference. Also incorporated by reference are: EP 0725283, FR 2634945, EP 0714082, DE 19504923, FR 2668012, DE 4216281, GB 2289556, and DE 4304562.

OBJECTS OF THE INVENTION

It is therefore a first object of the invention to change the large number of displays, masks etc. which can be displayed and processed on the small individual screens that are already known, into a form which can be displayed better and is more comprehensible. This will relieve the load on the controllers and improve not only taxiing safety, but also the safety of approach and departure movements and the processes linked to them. In particular it will make them even safer and simplify the controllers' work, thus allowing their concentration span to be lengthened.

SUMMARY OF THE INVENTION

These and other objects are achieved by a MMI designed as a screen whose diagonal is more than 19 inches, in particular more than 21 inches. Screens larger than 19 inches have not so far been used in towers at airports, and although the use of screens of up to 21 inches has already been discussed, they have not yet been introduced. The previous screen sizes were generally regarded as being satisfactory. Furthermore, disadvantages included constriction of the controllers' field of view. Surprisingly, however, the screen size according to the invention offers more advantages than disadvantages.

A refinement of the invention provides for the MMI to be designed to be interactive. In previously known MMIs for airports, the display unit and the switching devices, which are preferably designed as keyboards, have been separated. This means that the controllers have to concentrate even harder, and have to continuously check that the right switches have been operated. An interactive configuration overcomes these problems and improves safety.

Another object of the invention is to provide a flat screen for the MMI, in addition to the screen being larger than ever before. Surprisingly, this makes it possible for even larger-format screens, for example with screen diagonals of more than 100 cm, to be arranged in the field of view of controllers in airport towers, while maintaining sufficient visibility of the runways, taxiways etc. This has not been possible with previously used monitors, since they are very deep. A particularly advantageous feature of the invention is to use a high-resolution flat screen with a daylight (sunlight) capability. Flat screens which can be used in daylight are already known, for example from the document "Tageslichttaugliche Flachdisplays" [Flat displays suitable for daylight use] from Siemens AG, Bereich Datentechnik, [Data Technology Division] dated October 1995 and incorporated herein by reference. However, the size of these known flat screens is only 10.4 inches. It is therefore impossible to use them to display the large amount of information required on screens in air traffic control towers. These flat screens have booster light sources to make them suitable for use in daylight. Equivalent techniques can also be used for large flat screens and their superimposed displays.

To simplify the controller's work, the invention advantageously provides for the use of touch screens for integrated displays and for controlling facilities, for example stop bars etc., at an airport, thus allowing direct traffic management at the airport. This will allow the controllers to issue commands and control instructions in the tower, safely and without the controller having to change the direction he is looking in, in a far better way than when attempting to carry out "blind" operation with a keyboard and a mouse.

It has been found to be advantageous in this case to display menus and windows on the MMI screen. These menus and windows can be called up, added to and edited using a keyboard, as well as using Windows technology, for example with a mouse. Traffic-relevant data can thus be corrected and adapted on the same screen as the switching functions, resulting in an integrated process for the controller. As one example, all the activities relating to the traffic at an airport can be processed in one place such that, and this is particularly advantageous, it is possible for one man to control operations when traffic levels are low, even at a large airport.

The screen can advantageously display both aircraft and vehicle movement areas at the airport, preferably as processed video. Even at a large airport, the main traffic areas can be displayed with sufficiently high resolution on a screen size of at least 100 cm. The two or more runways and taxiways can be displayed either as processed video or as raw video, with the positions of stop bars and other signal transmitters, sensors and their switching and display states also being indicated and/or superimposed on the processed video. At the same time, the display can also show the flight numbers of the aircraft, possibly as well as their type labels. Even with this large amount of detail, a screen size of 19 or 21 inches can provide the required clarity, according to the invention, particularly if very large formats are used.

The invention envisages lists of aircraft on the approach, preferably listed alphanumerically, with aircraft that have recently departed also being listed, likewise alphanumerically, and preferably on free areas of the display, for example in the corners or at the sides of the video. This will provide the controller with a complete overview of airborne and taxiing traffic in his area of responsibility. Departure control is particularly important for gate allocation, and the docking process can advantageously be displayed as well, for example superimposed on the corresponding airport building display, for gate allocation.

The various video displays will preferably have aircraft position indications added, with aircraft indications and, possibly, with associated selected flight plan data, possibly together with vehicle identifications. A transponder system is particularly advantageous in this case, to provide identification reliability, as is shown, for example, in said U.S. Pat. No. 5,262,784. The MMI according to the invention displays both aircraft positions and other information superimposed, both in the respectively appropriate form, that is to say, for example, as raw video, as processed video, obtained optically or by radar, and directly or alphanumerically.

Details or sections from displays, switching states, positions etc. can advantageously be displayed enlarged (zoomed). For example, the precise positions of aircraft and, possibly, vehicles can advantageously be indicated in relation to individual lights, stop bars, sensors etc. The zoomed—and possibly also reduced—displays can optionally be arranged on free areas, or superimposed on the basic image.

The invention also allows aircraft and vehicles to be displayed on the basis of their current position on the movement areas, with an identification of the responsibility for the aircraft or vehicle. In consequence, task allocation is immediately evident, particularly at larger airports where a number of controllers are responsible for traffic management at the airport. The display of the responsibility for the aircraft or vehicle is advantageously linked to handover routines for a change in responsibility, for example in list form, for which purpose confirmation annotations, and corresponding list changes may be provided on the screen.

It is particularly advantageous to display routes planned by a computer facility, to avoid collisions and to have the capability to switch and display such routes, possibly also automatically. Corresponding procedures are evident from the already mentioned U.S. Pat. No. 5,374,932.

Specific position signals on the screen, for example "stop bar crossed", in this case improve safety, as does direct flight plan processing on the MMI. Filters for masking out information which is irrelevant at the moment, for example in the apron area or in the local control area, further improve the safety of traffic management using the MMI.

As a rule, control functions are normally separated at large airports, with handovers to other responsibility areas. The large screen according to the invention now allows just one controller to handle the traffic, particularly at times when traffic levels are low, by superimposing and/or successively displaying different charts or maps, for example of the airport layout, of zoomed sections, of the coordinate system, as well as of the areas which are open and closed to traffic, of the recommended routes, of the associated lists, and video displays of the docking process etc. As the traffic level increases, the monitoring and control work is then transferred to a number of controller positions.

In addition to the control functions, the invention advantageously allows the synthetic videos and charts or maps to be changed to match the task and/or level or authorization. The invention furthermore makes it possible to carry out save operations matched to the task and to output various configurations of the displays in conjunction with a computer unit. The MMI can thus advantageously be matched to different circumstances at the airport, to changed routines, routine sequences etc., with direct control of the results of the change. Thus, all the process steps required to operate an airport, even a large airport, can be carried out, following the initial installation of the computer unit and its software, on the MMI according to the invention.

Important additional information can also be displayed on the MMI according to the invention, since a large display area (which has never been used in the past) is available. Such information may include, for example, weather reports (for example the wind direction, the wind speed, etc.) as well as visibility details and other weather information.

The main work screen according to the invention can, of course, be connected to other screens, for example to screens showing details from air traffic control centers, in order to allow the traffic to be planned in advance. Such details from an additional screen may also, of course, be displayed on the main screen, for example in a corner. This results, overall, in the capability to display on one screen all the information required for operational traffic management at a large airport.

The individual superimposed displays, which are each required only for a specific time period, are possibly advantageously canceled again after a predetermined time, in order to revert to the basic state again. The image is then advantageously built up again from this basic state in the particular form required, depending on the situation.

It is also particularly advantageous to display an alarm signal, preferably in red or yellow, providing information about special situations. A list presentation can possibly also be used for this purpose, from which the individual times can be seen when special situations occur, together with the urgency for action on them and their action status.

The MMI can have touch elements and/or, at least on parts of a frame or a console, switches for operating, supplementing and/or producing redundancy for the signals emitted by switching (touch) elements. Producing redundancy is particularly important, since airports are subject to very stringent safety requirements. Touch or switching elements which are located in the controller's normal field of view are particularly suitable for this purpose, since they prevent the controller from having to interrupt his visual monitoring of the airfield, the taxiways etc. at any time.

The MMI screen is advantageously a plasma screen or gas-discharge screen, although it can likewise be an LCD screen with background lighting or an LED screen. Any of these techniques can be used to produce a large screen, with the plasma screen having the best resolution. Suitable plasma screens with particularly advantageous screen sizes of more than 100 cm are already known from the field of television. In this case, a touch screen can be designed such that sensitive coverings are arranged over the actual screen, for example in conjunction with a glass panel or a plastic sheet.

If the screen is designed to be very large, it is particularly advantageous to use a projection screen, for example a screen with laser projection. The superimposed displays according to the invention can then be produced particularly easily and brilliantly.

Despite its size, the screen is advantageously arranged in the controller's normal field of view, and it is advantageous for the screen to be arranged at a considerable angle to the vertical, with the angle being variable depending on the situation. In consequence, any adverse effect on the controller's field of view is acceptable. The oblique arrangement is assisted by the flat screen configuration, advantageously with the angle at which it is positioned depending on the time of day.

For particular requirements in a tower, ceiling fitting is also possible, in which case keyboard/mouse control is chosen. Nonreflective coatings are provided to prevent disturbing reflections. Electromagnetic radiation shielding is also provided.

For use in countries where English is not normally spoken, it is particularly advantageous for the MMI to provide multilingual details of the individual names, terms in use etc. The MMI is thus connected to a word memory, which contains details in various languages. In this case, it is particularly advantageous to have two configurations: one in the national language and one in the language of the manufacturer who will also carry out the maintenance work, so that his personnel can work in their own national language, with English as the general language for aviation.

BRIEF DESCRIPTION OF THE DRAWINGS

The invention and further advantageous refinements of the invention according to the features of the dependent claims are explained in more detail below with the aid of diagrammatic, exemplary embodiments in the drawing, in which:

DETAILED DESCRIPTION OF THE PREFERRED EMBODIMENTS

Figure 1:
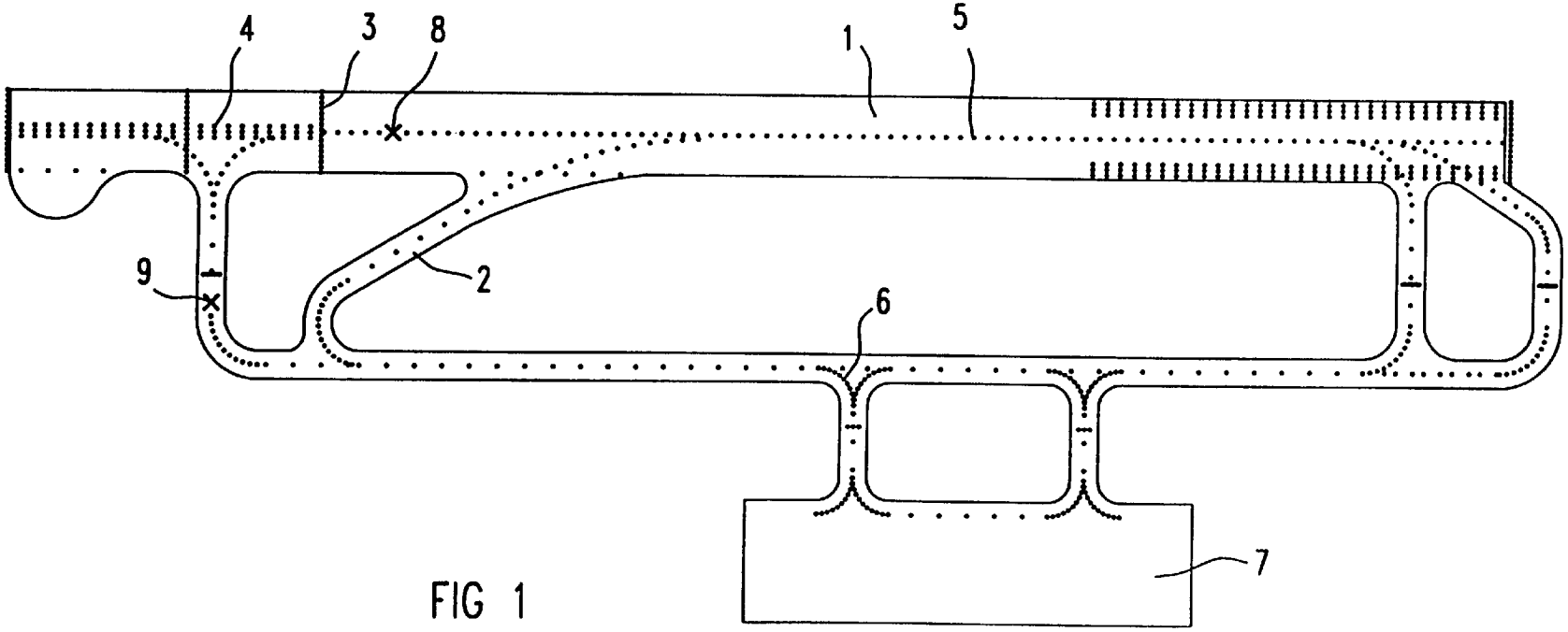
FIG. 1 shows an example of a display of a simple runway with taxiways and an apron area.

In FIG. 1, 1 denotes a runway and 2 a taxiway. Switchable center lights 5 and other flush lights 4 are arranged in the runway 1 and can be designed to emit both white and red light, or possibly green light. There is also a row of lights 3 in the runway, which is designed, for example, to illuminate in red. This row of lights may possibly give take-off clearance. The taxiway 2 likewise has center lights 6, which may emit various colors. In the apron area 7, there are other lights, which are not marked in any more detail and some of which have signal functions. Lights without signal functions are not shown. At times, there are aircraft on the runway 1 and on the taxiway 2, whose position is denoted, by way of example, by crosses 8 and 9. While both the display of the runway and taxiways, as well as the display of the buildings and, possibly, of the airport environment (which are not shown here) are fixed inputs for the display, the positions 8 and 9 of the aircraft originate from a radar video, which is advantageously superimposed on the display of the airport. Position areas in which aircraft are located can also, of course, be determined by sensors which are installed by the taxiways etc.

Figure 2:
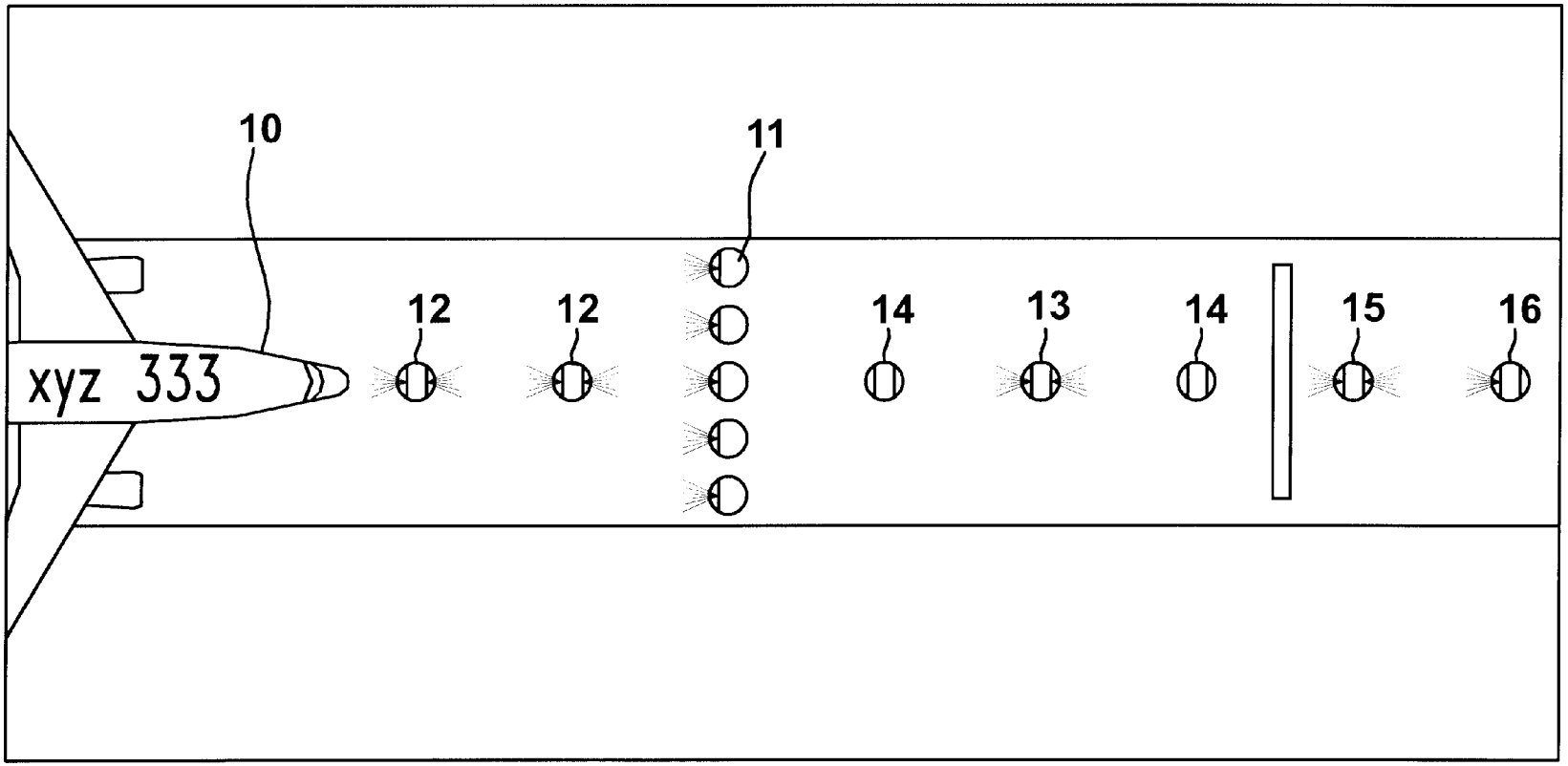
FIG. 2 shows an example of the switching state of the lighting before taxiing clearance.

In FIG. 2, 10 denotes an aircraft prior to taxiing, and 11 flush lights which are illuminated in red for the pilot. The flush lights 12 are illuminated in green, as is the flush light 13. The flush lights 14 are illuminated in white, while the flush light 15 is illuminated in green and the flush light 16 is illuminated in green on one side and in white on the other side.

Figure 3:
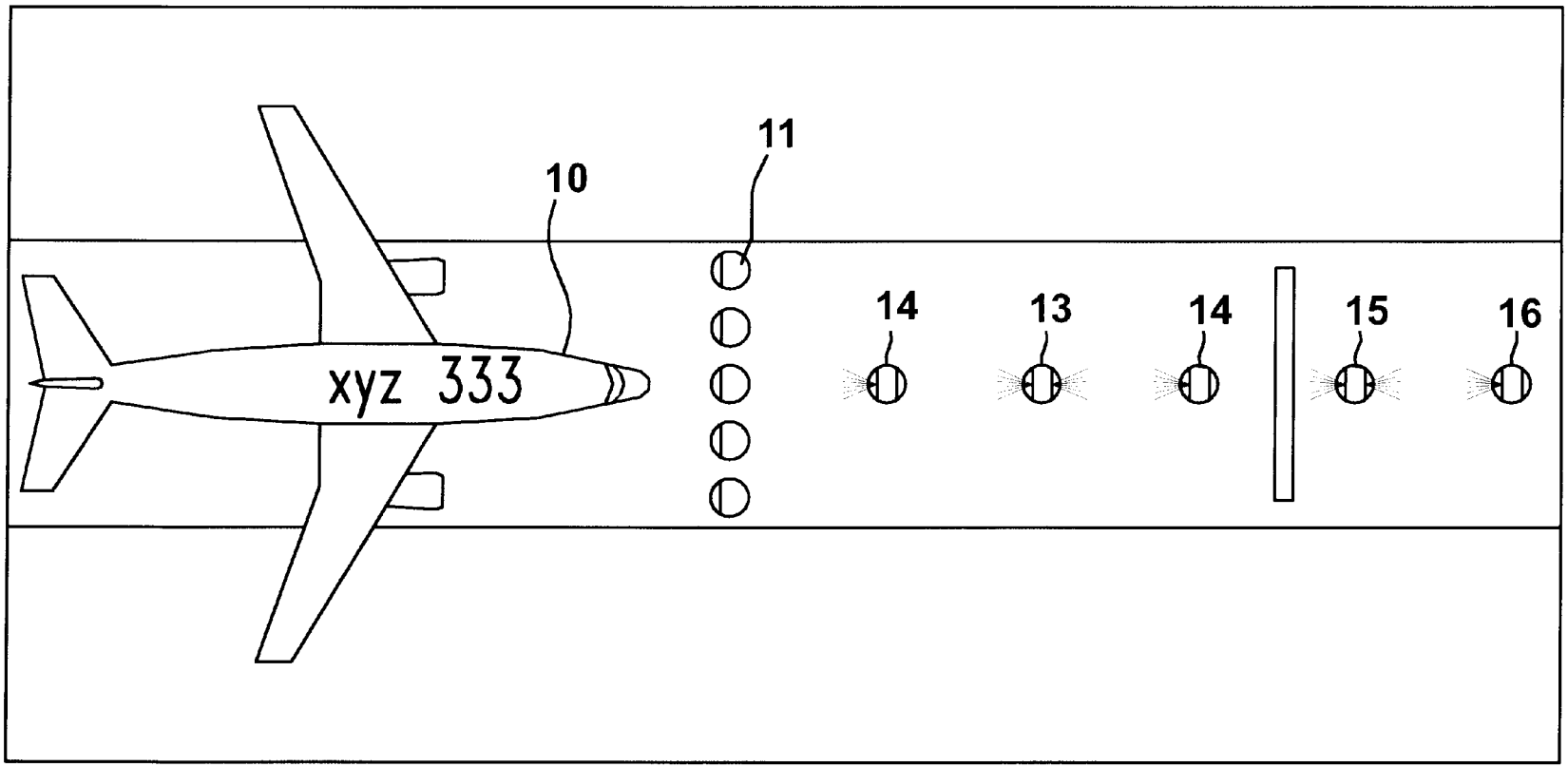
FIG. 3 shows an example of the switching state of the lighting after taxiing clearance.

FIG. 3 shows the signal state of the flush lights after taxiing clearance, and the pilot in the aircraft 10 sees each of the lights 13, 14, 15 and 16 as green, while the lights 11 are not illuminated. This results in clear signaling to the pilot in the aircraft 10 that the taxiing process can commence, and the signaling can be monitored on the screen.

Figure 4:
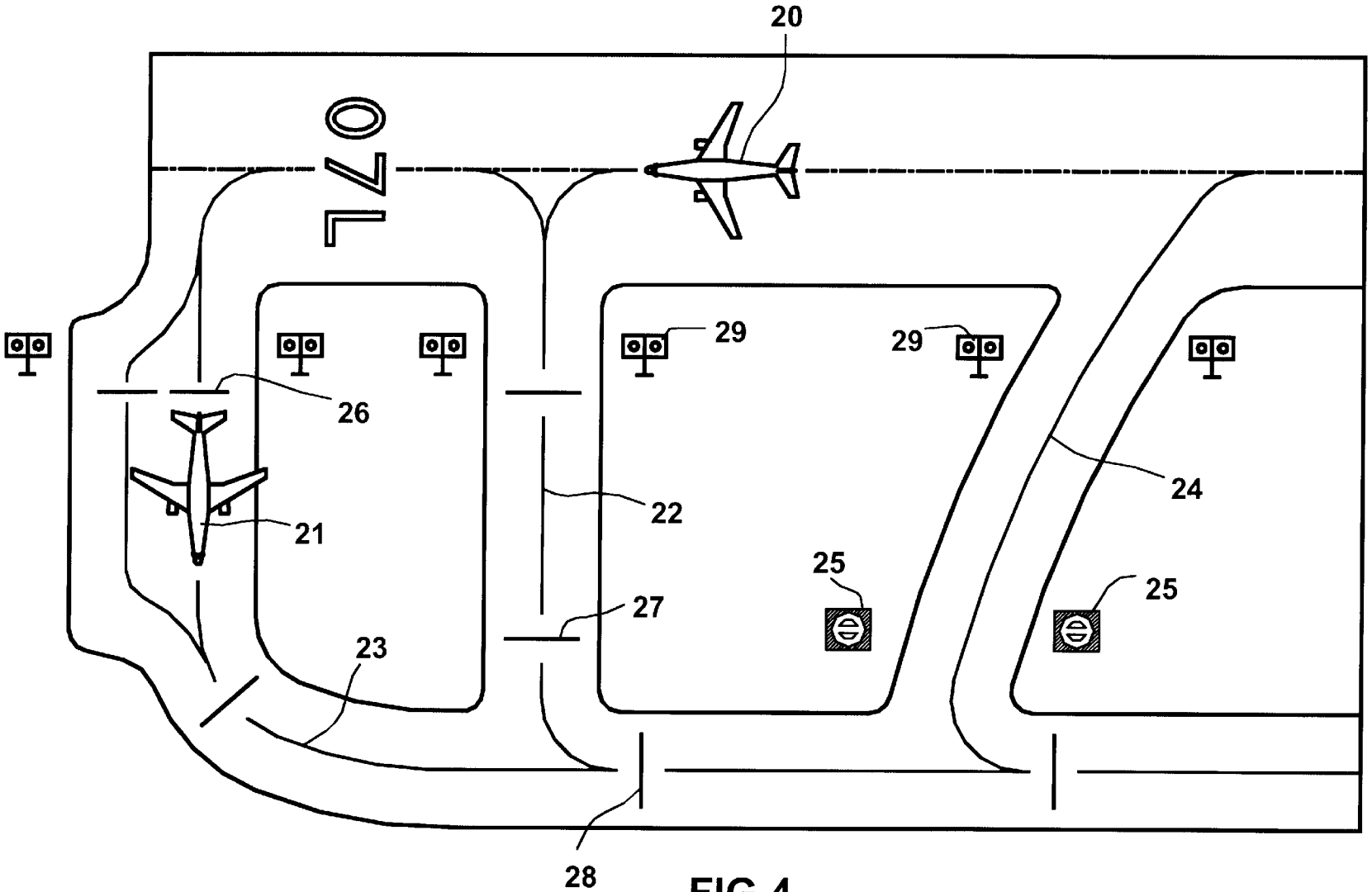
FIG. 4 shows an example of the switching state of the lighting and stop bars at the end of the runway when traffic is dense.

In FIG. 4, 20 denotes an aircraft at the end of the runway, and 21 denotes another aircraft on a taxiway. On the various taxiways, the taxiway center lights are in each case illuminated in green, for example in sections, in lines 22, 23 and 24, as required. They thus tell the pilots the route they must take. At the end of the individual interconnected rows, there are, for example, stop bars 26, 27 and 28, which indicate in red to the pilots that they may taxi only as far as this point.

Furthermore, there are no-entry notices 25, possibly in the end section of the runway shown, with the taxiways adjacent to it, which no-entry notices 25 are likewise illuminated, and sensors 29 are located on the entry side, and their details can supplement or replace radar displays. Such sensors are preferably designed as microwave sensors and may allow or control block-by-block switching of flush lights, as is known for signals for railroad traffic.

The above figures show a number of examples for safe taxiing on the ground, in a way which can be monitored and carried out according to the invention by means of large flat screens. In this case, the known control panels have been replaced by a model of the airport geography, and with a large number of switches. Known control panels operated with optical conductors or individual diodes, and possibly with small incandescent bulbs as well. It is not possible for any radar videos or additional information about the traffic situation at an airport to be transferred to such facilities. However, this is possible according to the invention by virtue of the large display areas, which are advantageous, in particular, in conjunction with interactive screens, such as touch screens or the like.

Figure 5:
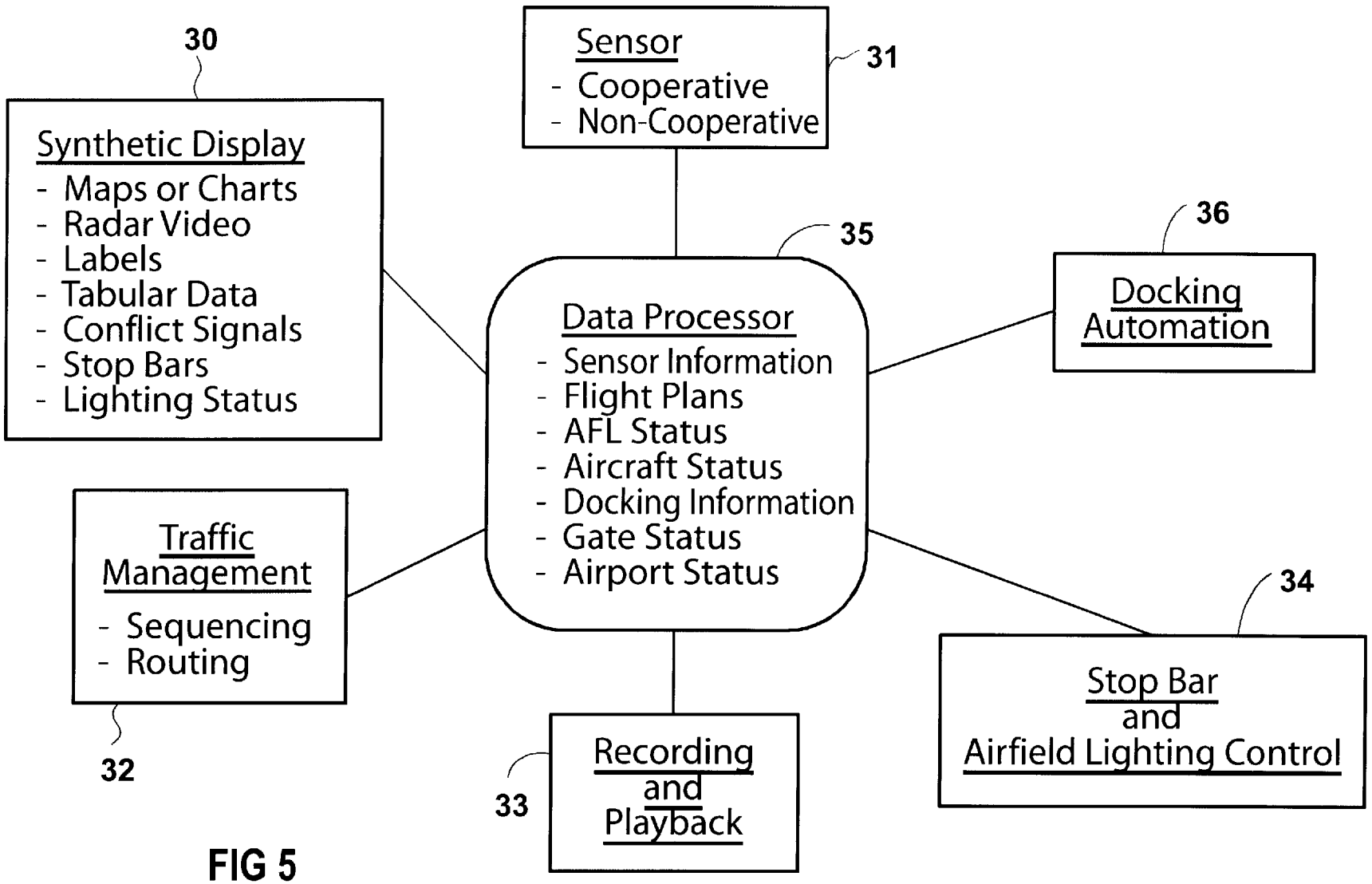
FIG. 5 shows an overview of the major information provided.

In FIG. 5, the major details contained in the synthetic video are listed at 30. The details from the radar video are advantageously superimposed on the synthetic video, so that the actual information about the position of aircraft and/or possibly vehicles can be seen from the synthetic video. 31 shows the two types of sensors, which can operate on a very different basis. Most important are the interactively operating sensors which at the same time verify the aircraft identification, for example by means of transponders. 32 shows the basic routes for the traffic management system on the ground and in the air in order to provide aircraft with safe instructions, guaranteeing a smooth traffic flow. 33 shows auxiliary functions which are important particularly in the event of any special occurrences. 34 shows the major components for management of the aircraft on the runway and the taxiways, and in the apron area, while 36 shows the docking automation, which can be carried out using a very wide range of sensors, preferably with line-scan cameras, which use pattern comparison, or alternatively using lasers, microwave receivers etc., possibly with support from D-GPS etc. Finally, 35 shows the integration of the widely different types of data which flow together in the system and can be displayed on the screen together with the information from 30, 32, 34 and 36. The sensor information includes the radar information, of course, the main information source at an airport.

It is self-evident that the system according to the invention is still used even if all the individual components described here are not integrated in the system but are operated as stand-alone systems, or if individual components, such as automatic docking systems, do not exist at all, for example at relatively small airports with only a few parking positions. The basis of integrated control of aircraft and, possibly, vehicles remains as the solution according to the invention.

Figure 6:
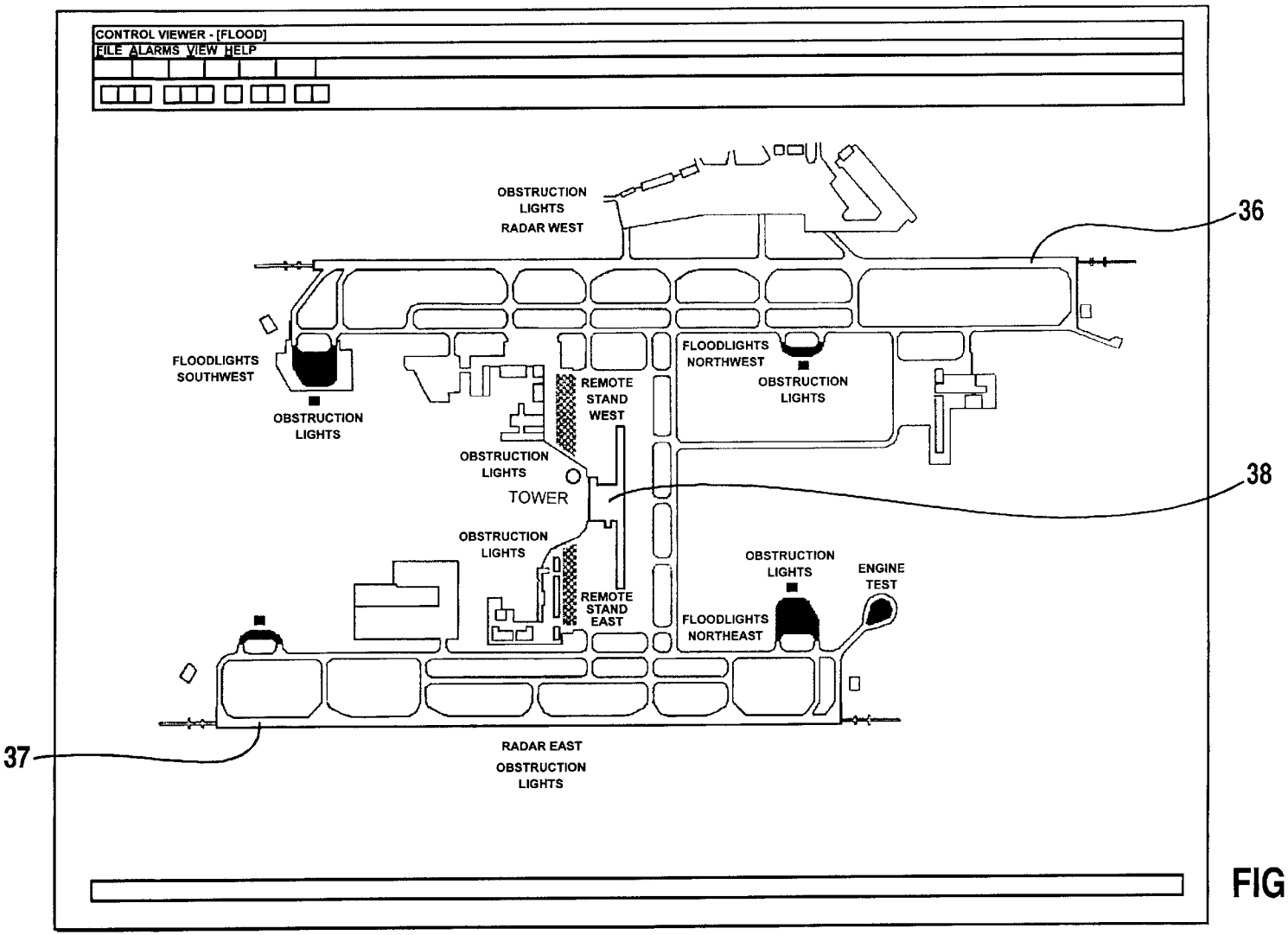
FIG. 6 shows a large-format map of a large airport.

In FIG. 6, the overall view of a large airport, 36 and 37 denote the runways, and 38 the actual airport buildings in the center between the runways and the taxiways, which are associated with the runways but are not shown in any more detail. This overall view is used for clarity and, in particular, to choose the zoom sections.

Figure 7:
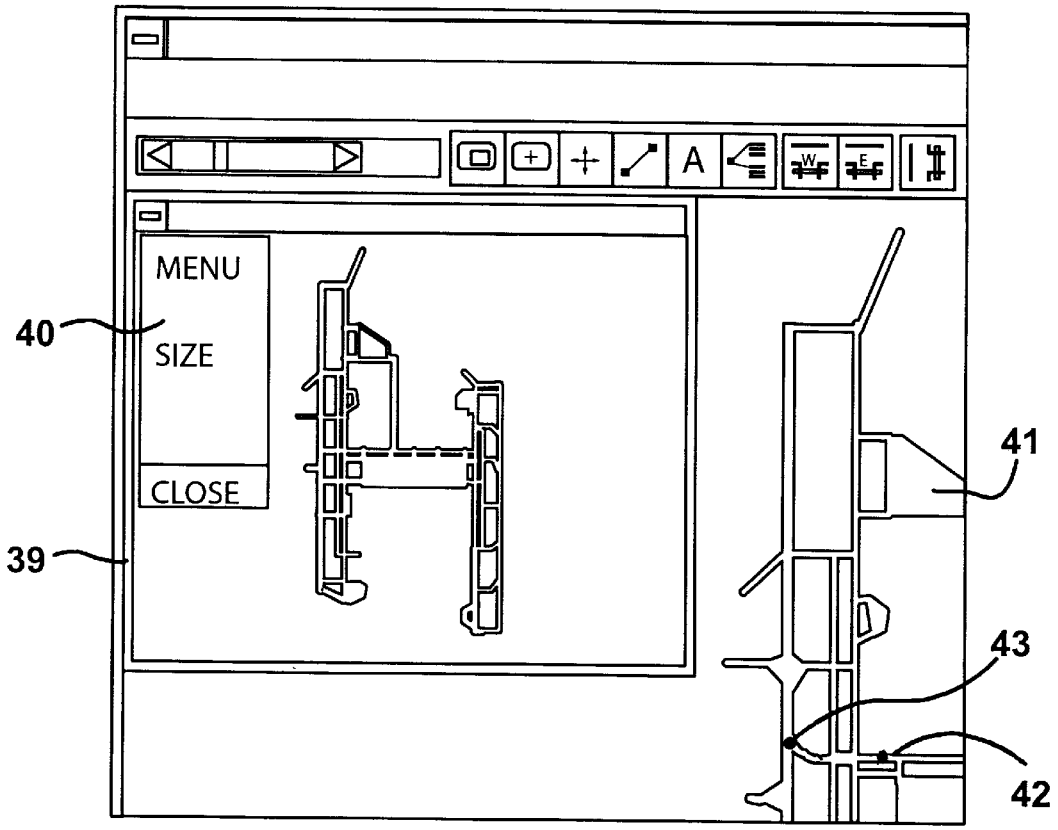
FIG. 7 shows a window display of the large airport from FIG. 6 and a detail enlargement, both with aircraft positions.

In FIG. 7, 39 denotes a window, in this case arranged in the top left-hand corner of the screen, with a highly scaled-down illustration of the airport from FIG. 6. The window also includes an area for clicking on the various work functions using a mouse. Superimposed displays of aircraft positions with further details can also be superimposed in the window 39; such advantages are perfectly feasible on a large screen, owing to the clearer legibility. Alongside the window 39 there is an enlarged display 41 of a runway-taxiway section, with superimposed aircraft position details 42 and 43. This display makes it easier to select further zoom displays than in the window 39.

Figure 8:
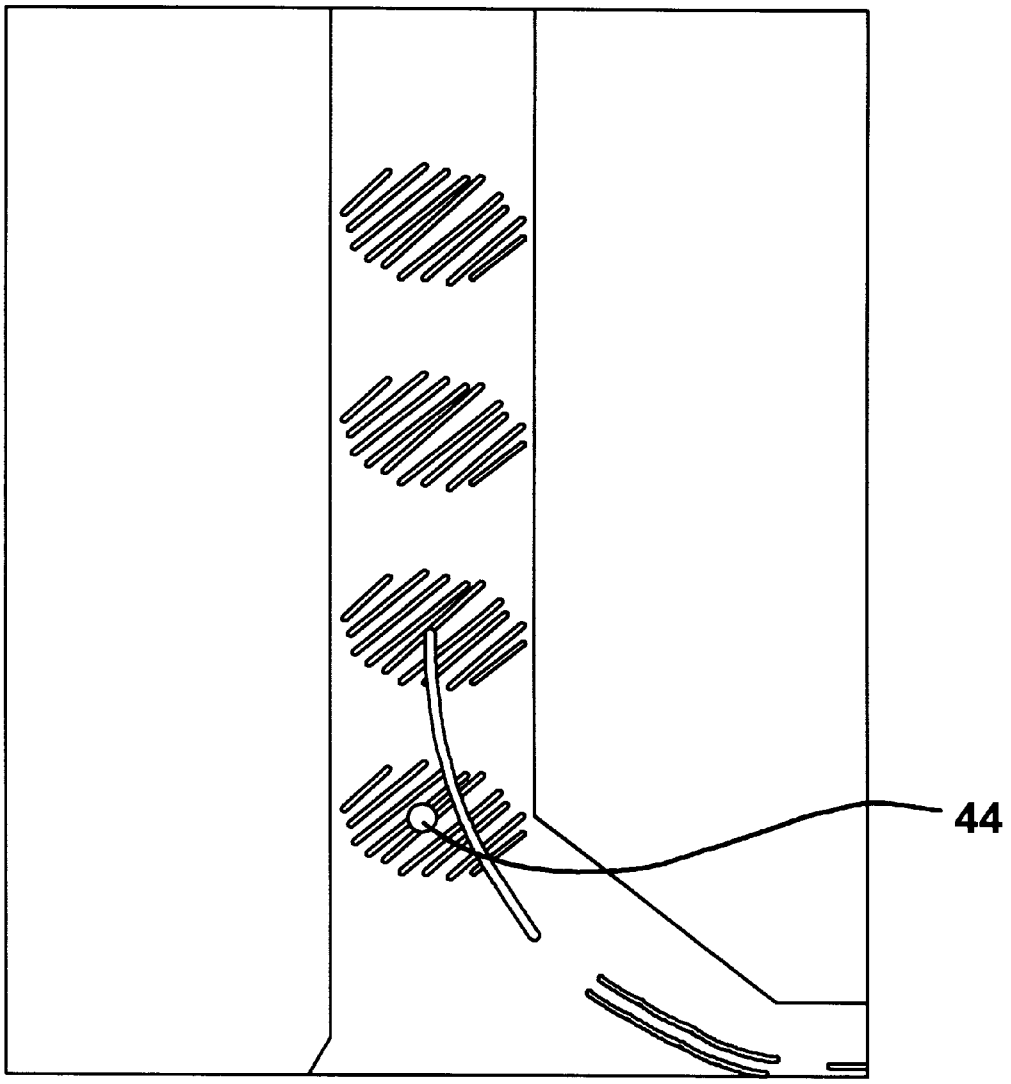
FIG. 8 shows a zoom display of detail enlargement from FIG. 7.

Finally, FIG. 8 shows the zoom display of an aircraft position, with identification details being provided for the aircraft. The position of the aircraft is represented by a dot 44, on which an area with after-glow can be superimposed. This makes it easier to follow the movement of the aircraft. The details about which aircraft this is may, as can be seen, be on one line, or else may be increased up to three lines. All the relevant information relating to an aircraft, such as the aircraft type, flight number, callsign etc. can then be displayed, or alternatively airport-specific data, such as the gate number and the category to which the aircraft must be allocated.

Figure 9:
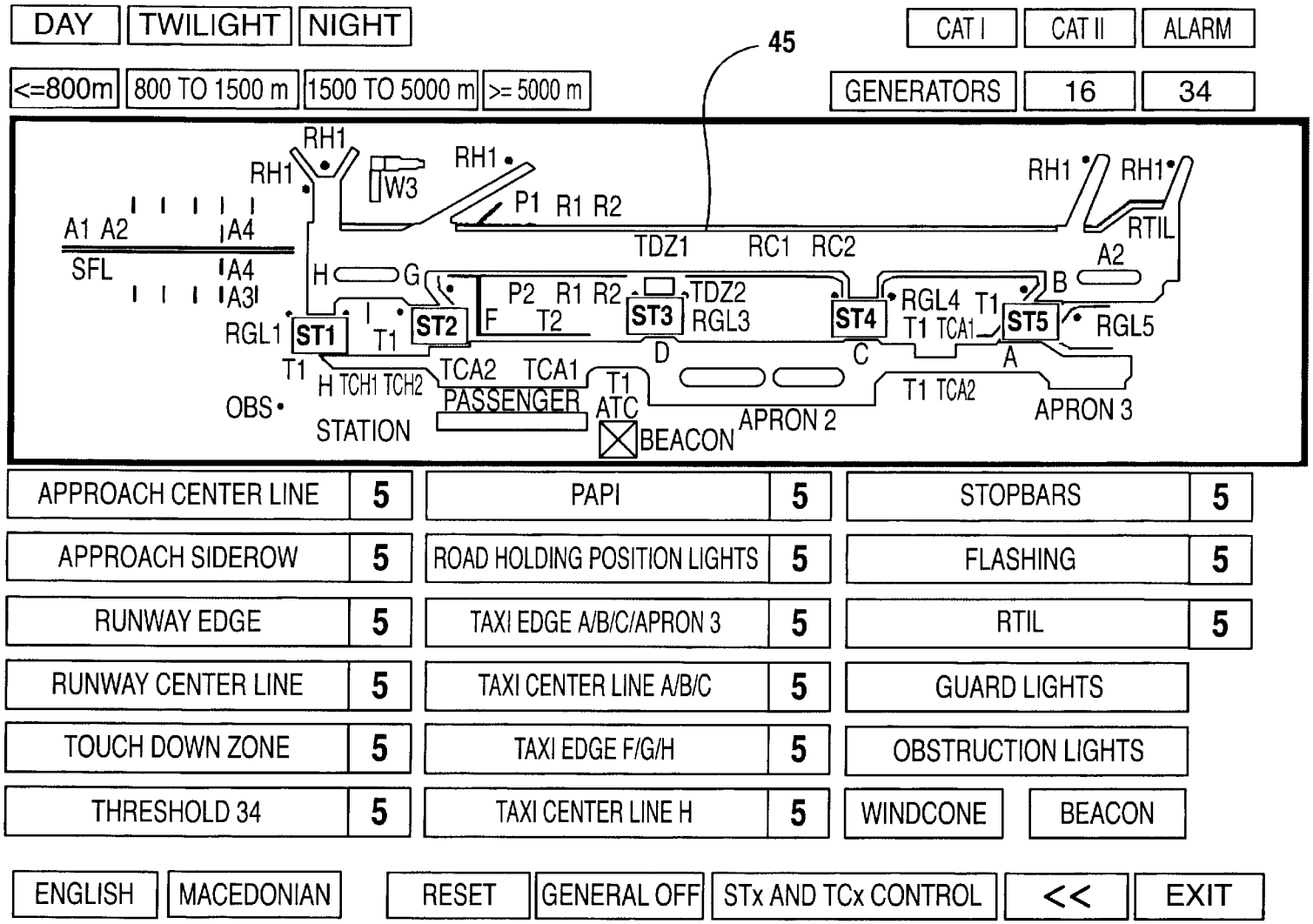
FIG. 9 shows an overview of a relatively small airport with control function blocks.

FIG. 9 shows a schematic view of an airport map for a relatively small airport. The display and the control windows are designed to allow touch control. The display may be in the national language, in English or in any other desired language. The airport has only one runway 45. The other aeronautically important details can be seen on the display.

Figure 10:
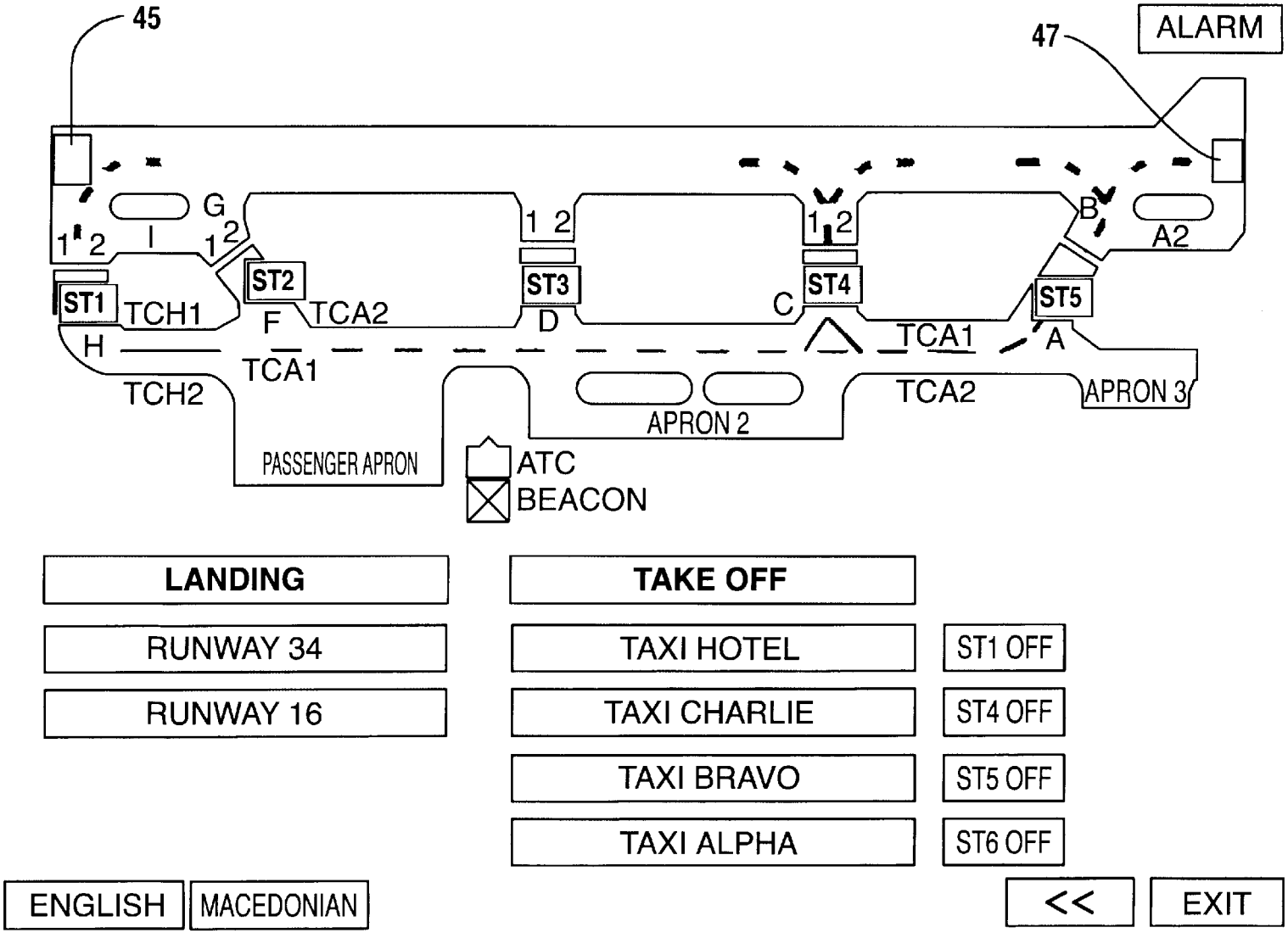
FIG. 10 shows an enlarged display of the airport from FIG. 9 with selective details.
Figure 11:
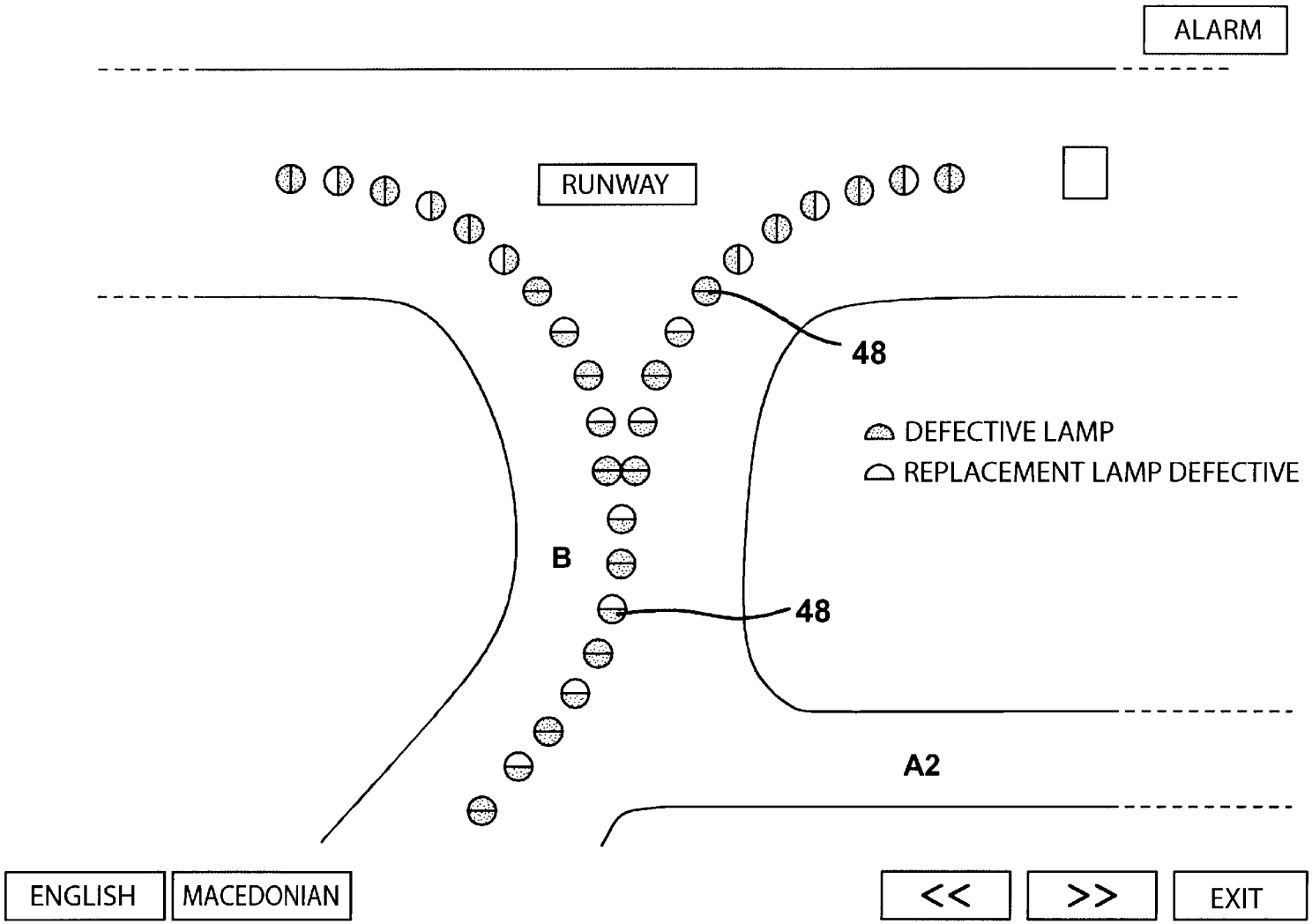
FIG. 11 shows a zoom display of the lighting at the airport from FIG. 10, and FIGS. 12 to 14 show a superimposed display of the individual runway lights with section details from the map of a relatively small airport.

The display in FIG. 10 now shows a greater resolution and has control buttons which allow the individual runway parts and taxiways to be selected. The two runway parts are denoted by 45 and 47, and correspond to the details for the runway 16 and runway 34 on the control buttons. The stop bars are denoted by ST1 to ST5. Once again, zooming to control the individual lights is possible with this display, as is shown, by way of example, in FIG. 11. The individual fights are denoted by 48 in FIG. 11. The corresponding enlargement also clearly shows the individual switching state of the lights. A superimposed display of an aircraft is possible.

Figure 12:
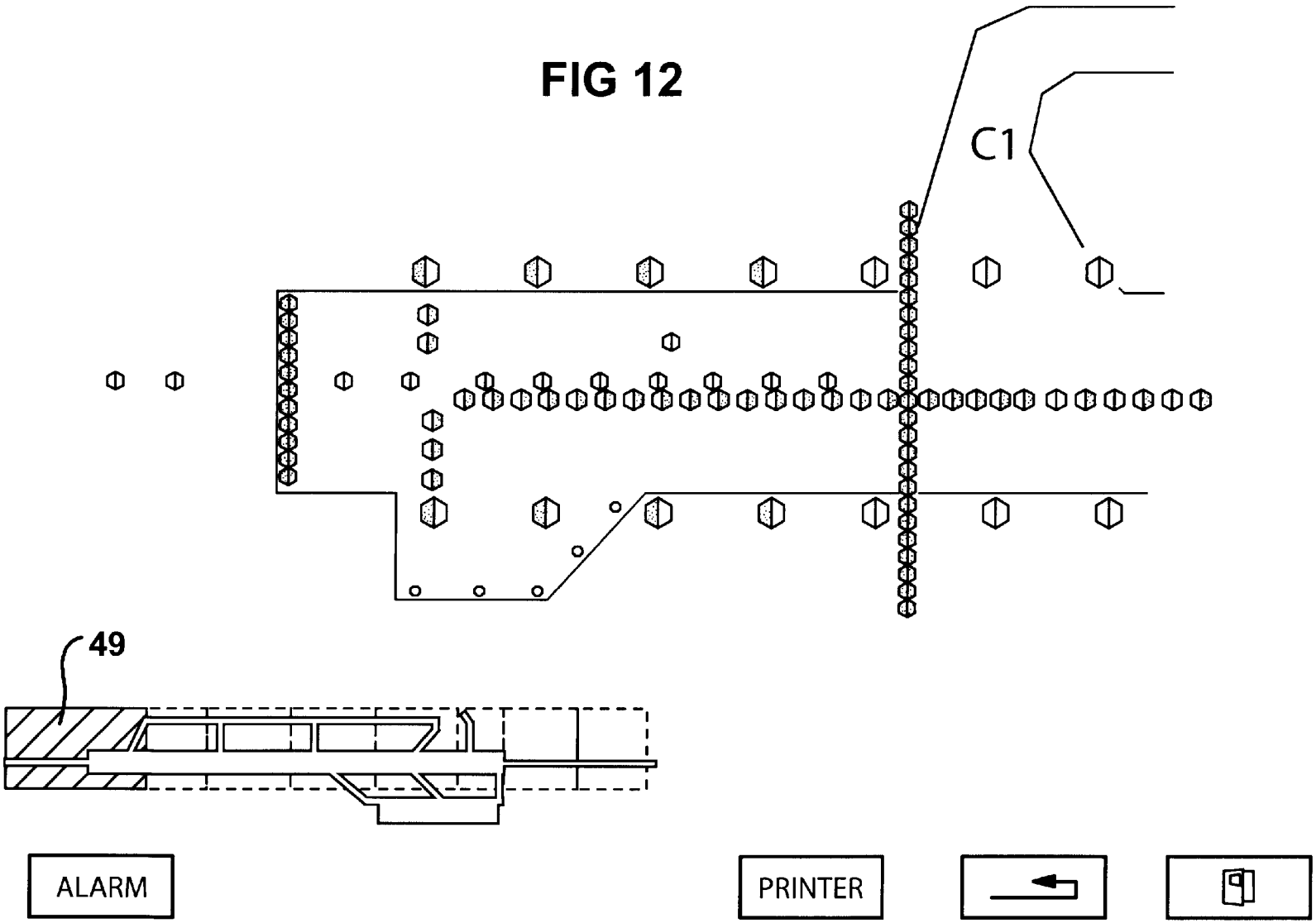
Figure 13:
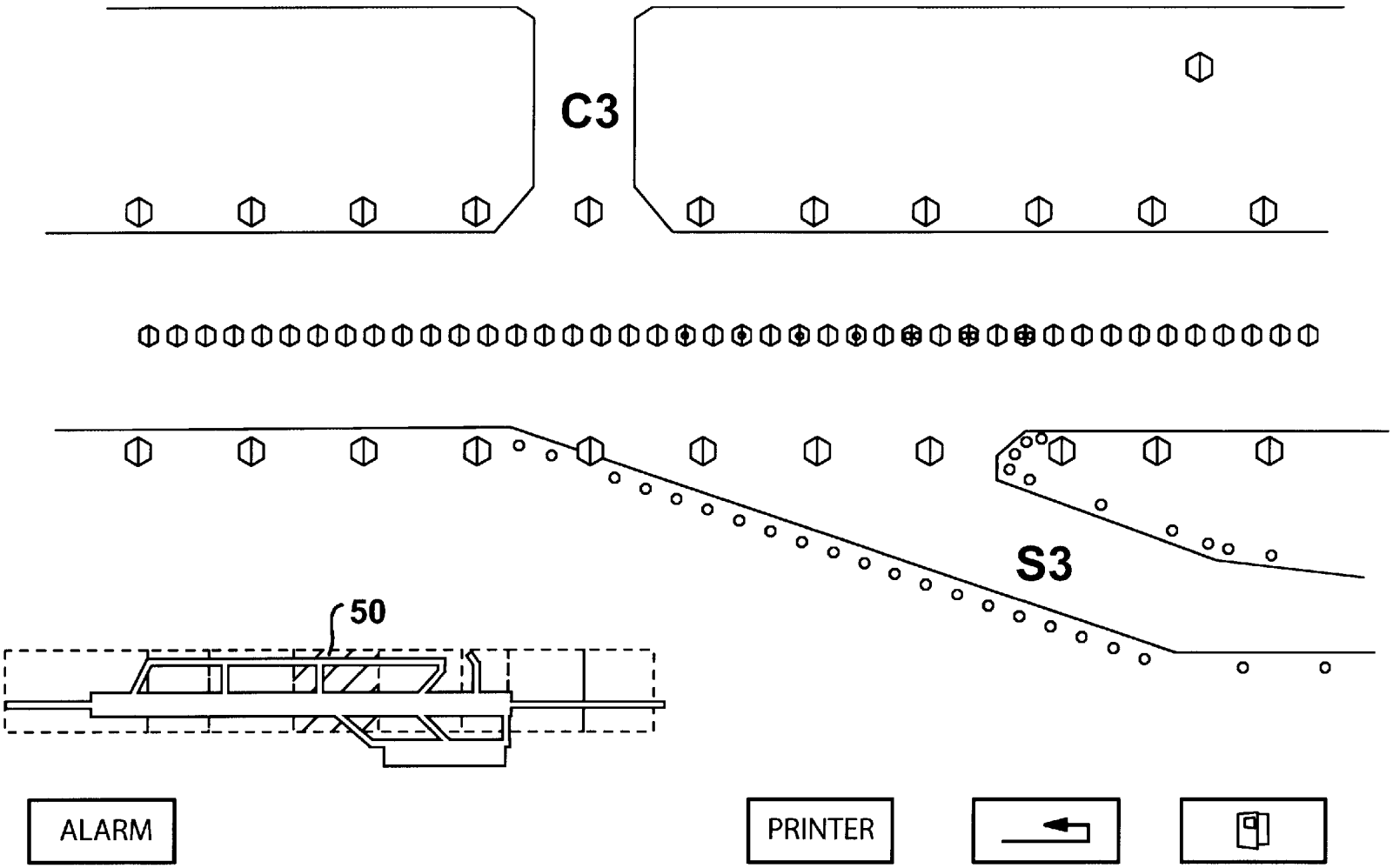
Figure 14:
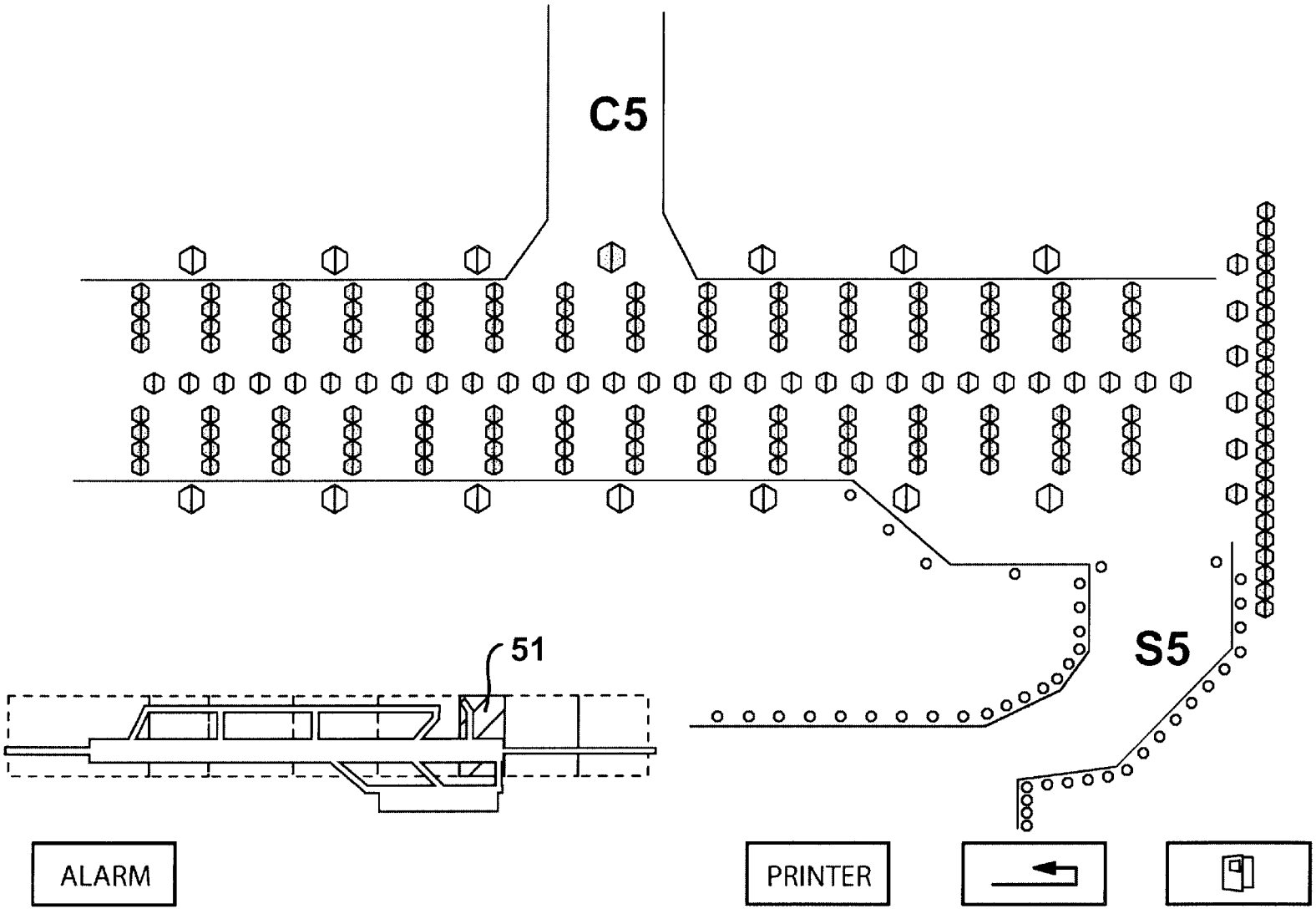

Finally, FIGS. 12 to 14 show enlarged (zoomed) details of a small airport, whose basic configuration can be seen from the superimposed image at the foot of the zoomed display. In order to show the precise position of the respective section, the zoomed display shows a plan of the airport with details of the zoom section. FIG. 12 thus shows a zoom section 49 with the switching display for the individual lights, FIG. 13 shows the zoom section 50, likewise with an enlarged display of the individual lights, and FIG. 14 shows the zoom section 51, likewise with an enlarged display of the individual lights. The respective switching state, a failure etc., can also be seen from the enlarged display of the individual lights in FIGS. 12 to 14. Superimposition of the aircraft position in the sections 49, 50 and 51, which are illustrated here only by way of example, is particularly advantageous. There are other sections, which are not shown in detail, between the illustrated sections.

Irrespective of whether the airport is small, relatively large or even large, the MMI according to the invention is able to supply all the information required for operational management of an airport in a form which provides complete information safety. Although tower controllers have been able to work well with the previous, relatively small screens, it has been found surprisingly that a considerable enlargement of the screen size and, in particular, a configuration as a flat screen, makes it possible to achieve a further improvement in safety, an improvement in taxiing control, and better operational management of an airport overall. One precondition for this is, in particular, the superimposition of the various information items required on a relatively large area, which the MMI makes possible in conventional form by known technologies (windows and menu control), preferably using Windows NT and radar video generation, which can be carried out based on the method used by the Company HITT, in Holland.

The above description of the preferred embodiments has been given by way of example. From the disclosure given, those skilled in the art will not only understand the present invention and its attendant advantages, but will also find apparent various changes and modifications to the structures disclosed. It is sought, therefore, to cover all such changes and modifications as fall within the spirit and scope of the invention, as defined by the appended claims, and equivalents thereof.

What is claimed is:

1. A man-machine interface (MMI) for airport traffic control, comprising:

a display area on which processes and states at the airport are displayed and by which the processes and states at the airport are controlled, wherein said display area is provided on at least one screen having a diagonal that is greater than 19 inches and which is an interactive flat screen for an aircraft control facility, and wherein the processes and states controlled by said display area include taxiway route directives generated for an aircraft at the airport.

2. The MMI as claimed in claim 1, wherein the airport traffic control includes safe taxiing and approach-departure control at the airport, and the processes and states include movements and current positions of aircraft and switching states of lighting systems.

3. The MMI as claimed in claim 1, wherein the diagonal of said flat screen is greater than 21 inches.

4. The MMI as claimed in claim 1, wherein the flat screen is a high resolution screen designed for use in daylight.

5. The MMI as claimed in claim 1, wherein said MMI has a booster light source.

6. The MMI as claimed in claim 5, wherein said booster light source comprises at least one of gas discharge lamps or glass fiber light sources for specific pixels.

7. The MMI as claimed in claim 1, wherein said screen is a touchscreen for integrated display and control of traffic control facilities at the airport.

8. The MMI as claimed in claim 1, further comprising a keyboard and a mouse connected to said screen, for entering commands at precise points and for changing details and displays.

9. The MMI as claimed in claim 8, wherein the details and displays include the size of the displays.

10. An MMI as claimed in claim 8, wherein said MMI displays menus and windows which are completed and changed via said keyboard, and which are called up and positioned using WINDOWS technology.

11. An MMI as claimed in claim 1, wherein said display area includes display on said screen of movement areas for at least one of aircraft and vehicles at the airport.

12. An MMI as claimed in claim 11, wherein the movement areas are displayed as processed video.

13. The MMI as claimed in claim 11, wherein the at least one of the aircraft and the vehicles are displayed as superimposed on either a raw radar video or a processed video.

14. The MMI as claimed in claim 11, wherein said display area includes at least one free area of said screen for at least one list of aircraft on an approach to the airport.

15. The MMI as claimed in claim 11, wherein said display area includes at least one free area of said screen for at least one list of aircraft recently departed from the airport.

16. An MMI as claimed in claim 1, wherein the processes and states displayed include processes and states of switchable devices at the airport, aircraft identifications and position indications for the aircraft superimposed on a video display.

17. An MMI as claimed in claim 16, wherein the switchable devices are additionally controlled by means of said display area.

18. An MMI as claimed in claim 16, wherein the processes and states displayed further include selected flight plan data for the aircraft.

19. An MMI as claimed in claim 16, wherein the processes and states displayed further include vehicle identification information received from vehicle transponders.

20. An MMI as claimed in claim 11, wherein said display area comprises at least one area for displaying at least a portion of at least one of the movement areas enlarged.

21. The MMI as claimed in claim 11, wherein said display area includes real-time position information for the aircraft and vehicles on the movement areas.

22. The MMI as claimed in claim 21, wherein said display area further includes identifications of responsibility for the aircraft or vehicle.

23. The MMI as claimed in claim 11, wherein said display area displays and controls guidance facilities for aircraft for switching the guidance facilities either individually or in groups, the guidance facilities including at least one of stop bars, guidance lights, and centerline sections.

24. The MMI as claimed in claim 11, wherein said display area is configured to receive, switch and display routes generated by a computer facility for avoiding collisions.

25. The MMI as claimed in claim 1, wherein said display area is configured to receive and display specific position signals originating from sensor signal outputs.

26. The MMI as claimed in claim 1, wherein said display area is configured to receive and output flight plan processing actions.

27. The MMI as claimed in claim 1, further comprising filters for masking out information designated as irrelevant.

28. The MMI as claimed in claim 1, wherein said display area displays raw video and includes a zoom feature for enlarging details of the raw video.

29. The MMI as claimed in claim 1, wherein the raw video comprises at least one of a radar video and a television video of at least one docking position.

30. An MMI as claimed in claim 1, wherein said display area displays a synthetic video of available aircraft routes and positions of switchable information aids.

31. An MMI as claimed in claim 30, wherein said display area further displays actual aircraft positions and routes, and comprises at least one of touch elements, a keyboard, and a mouse for controlling the switchable information aids.

32. The MMI as claimed in claim 30, wherein at least one chart is superimposed on said display area for indicating at least one of an airport layout, a coordinate system, and areas which are open or closed for traffic.

33. The MMI as claimed in claim 32, wherein the chart is a partly transparent overlay on said display area.

34. The MMI as claimed in claim 30, wherein said display area selectively displays one of several available synthetic videos in response to a selected task or authorization code.

35. The MMI as claimed in claim 1, wherein said display area comprises an area for displaying weather condition information.

36. The MMI as claimed in claim 1, wherein said display area is coupled to a computer unit for performing a save operation of a given display configuration.

37. The MMI as claimed in claim 1, wherein said display area integrates airport operational traffic management information onto said one screen.

38. The MMI as claimed in claim 37, wherein said display area is connected to a further screen that displays other aircraft that are not at the airport but are under direct responsibility of the airport traffic control, in such a manner that display of the other aircraft transfers to the one screen when the other aircraft is at the airport.

39. The MMI as claimed in claim 1, wherein said display area reverts from a specific display status to a basic status after a predetermined time in the specific display status.

40. The MMI as claimed in claim 1, wherein said display area further displays an alarm signal for identifying special situations.

41. The MMI as claimed in claim 40, wherein the special situations include failure of an airport facility, and wherein the alarm signals are displayed as a chronological list.

42. The MMI as claimed in claim 1, wherein said display area further displays maintenance information.

43. The MMI as claimed in claim 7, wherein said touchscreen comprises touch elements, said MMI further comprising switching elements for supplementing said touch elements.

44. The MMI as claimed in claim 7, wherein said switching elements are provided on a frame or on a console of said MMI, and wherein at least some of said switching elements are redundant to said touch elements.

45. The MMI as claimed in claim 1, wherein said screen is a plasma screen or a gas-discharge screen.

46. The MMI as claimed in claim 1, wherein said screen is a liquid-crystal-display screen with background lighting.

47. The MMI as claimed in claim 1, wherein said screen is a light-emitting-diode screen.

48. The MMI as claimed in claim 1, wherein said screen is a projection screen.

49. The MMI as claimed in claim 1, wherein said screen is supported in a controller's working field of view and is arranged with an adjustable inclination.

50. The MMI as claimed in claim 1, wherein said screen is supported above a controller's working field of view and is operated to control the processes and states with a pointer.

51. The MMI as claimed in claim 1, wherein said screen is provided with a non-reflective coating and is shielded against electromagnetic interference.

52. The MMI as claimed in claim 1, wherein said display area displays words selectively in at least one of a plurality of languages.

53. The MMI as claimed in claim 1, wherein the taxiway route directives generated for the aircraft are displayed on and controlled by said display area.

54. The MMI as claimed in claim 1, wherein the processes and states controlled by said display area include route directives generated by airport signaling lights for an individual aircraft in the airport traffic.

55. The MMI as claimed in claim 1, wherein the processes and states controlled by said display further include route directives generated for a non-aircraft vehicle at the airport.

56. A man-machine interface for an airport traffic control station, comprising:

a display field configured as an output device to display processes and states at the airport, said display field provided on a screen having a diagonal of at least 19 inches; and a control field imposed over, in or under said display field and configured as an input device to control the processes and states at the airport;

wherein the processes and states at the airport comprise taxiway control processes and states that direct movement of the airport traffic in taxiways of the airport.

57. The man-machine interface according to claim 56, wherein the processes and states include taxiway route directives generated by airport signaling lights for an individual aircraft in the airport traffic.

58. The man-machine interface according to claim 56, wherein the processes and states include route directives generated for a non-aircraft vehicle at the airport.

59. The man-machine interface according to claim 56, wherein:

said display field displays a graphical representation of a movement area in which the airport traffic moves;

said control field is further configured as an input device to control the graphical representation by enlarging the graphical representation in said display field.

60. The man-machine interface according to claim 56, wherein:

the processes and states include real-time position information for the airport traffic; and the traffic control processes and states include switching states of airport lights having airport traffic signaling functions.

61. The man-machine interface according to claim 56, wherein:

the processes and states at the airport comprise control processes and states that direct movement of the airport traffic in an apron area of the airport.

* * * * *